US011261716B2

(12) United States Patent
Antonsen et al.

(10) Patent No.: US 11,261,716 B2
(45) Date of Patent: Mar. 1, 2022

(54) SYSTEM AND METHOD FOR STIMULATING A WELL

(71) Applicant: COMITT WELL SOLUTIONS US HOLDING INC., Katy, TX (US)

(72) Inventors: Roger Antonsen, Houston, TX (US); Mohamed Saraya, Sugarland, TX (US)

(73) Assignee: Comitt Well Solutions LLC, Katy, TX (US)

( * ) Notice: Subject to any disclaimer, the term of this patent is extended or adjusted under 35 U.S.C. 154(b) by 0 days.

(21) Appl. No.: 16/748,526

(22) Filed: Jan. 21, 2020

(65) Prior Publication Data

US 2020/0157926 A1 May 21, 2020

Related U.S. Application Data

(63) Continuation of application No. PCT/US2018/018703, filed on Feb. 20, 2018.

(60) Provisional application No. 62/565,547, filed on Sep. 29, 2017.

(51) Int. Cl.

| | |
|---|---|
| ***E21B 43/26*** | (2006.01) |
| ***E21B 33/128*** | (2006.01) |
| ***E21B 23/10*** | (2006.01) |
| ***E21B 34/10*** | (2006.01) |

(52) U.S. Cl.

CPC ..... *E21B 43/26* (2013.01); *E21B 33/1285* (2013.01); *E21B 23/10* (2013.01); *E21B 34/102* (2013.01); *E21B 2200/06* (2020.05)

(58) Field of Classification Search

CPC .. E21B 2200/06; E21B 23/10; E21B 33/1285; E21B 34/102; E21B 34/14; E21B 43/26

See application file for complete search history.

(56) References Cited

U.S. PATENT DOCUMENTS

| | | | | |
|---|---|---|---|---|
| 5,209,304 | A * | 5/1993 | Nice | E21B 23/10 166/154 |
| 2006/0124310 | A1* | 6/2006 | Lopez de Cardenas | E21B 43/08 166/313 |
| 2013/0112435 | A1* | 5/2013 | Fleming | E21B 23/006 166/386 |
| 2015/0034330 | A1* | 2/2015 | Merron | E21B 34/08 166/373 |
| 2018/0003003 | A1* | 1/2018 | Cleven | E21B 34/102 166/271 |

FOREIGN PATENT DOCUMENTS

| | | | | |
|---|---|---|---|---|
| AU | 2015279426 | A1 * | 2/2017 | E21B 34/14 |
| GB | 2247481 | A * | 3/1992 | E21B 33/1208 |
| WO | WO-2016106447 | A1 * | 7/2016 | E21B 43/26 |

* cited by examiner

*Primary Examiner* — James G Sayre
(74) *Attorney, Agent, or Firm* — Pierson IP, PLLC

(57) ABSTRACT

Embodiments disclosed herein describe fracturing methods and systems, wherein pressure differentials and fluid flow rates may be utilized to stimulate multiple zones, sleeves, or ports with the same tool.

18 Claims, 9 Drawing Sheets

FIGURE 6A
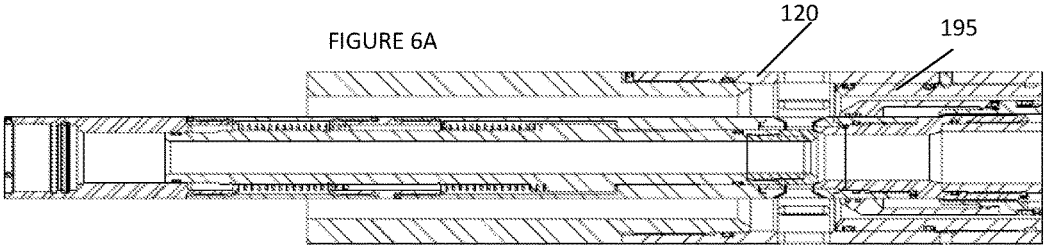
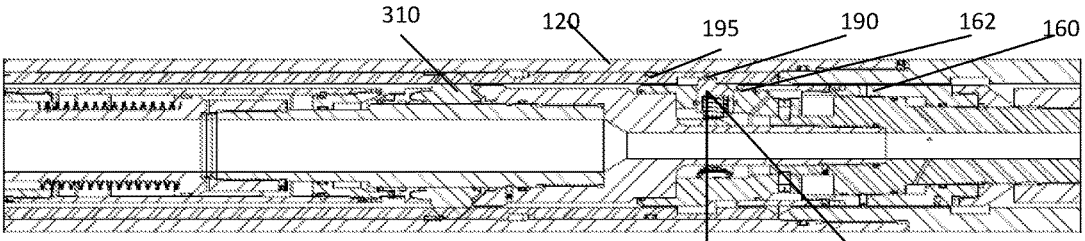
FIGURE 6B
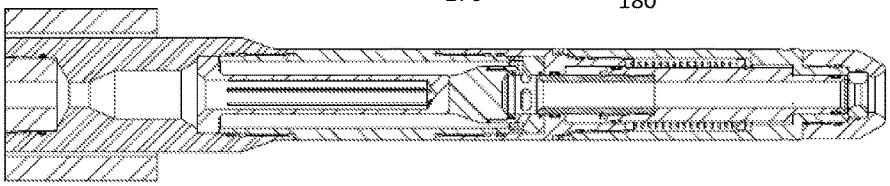
FIGURE 6C

SYSTEM AND METHOD FOR STIMULATING A WELL

CROSS-REFERENCE TO RELATED APPLICATIONS

This application is related with U.S. Ser. No. 15/197,158, which is fully incorporated herein by reference in its entirety.

BACKGROUND INFORMATION

Field of the Disclosure

Examples of the present disclosure relate to systems and methods for stimulating a well utilizing a pressure within the inner diameter of a tool. More specifically, in embodiments, increasing the pressure within the inner diameter of the tool may couple the tool to sliding sleeve, allowing the sliding sleeve to move based on the pressure within the inner diameter of the tool.

Background

For purposes of communicating well fluid from surface and vice versa, the well may include tubing. The tubing typically extends downhole into a wellbore of the well for purposes of communicating well fluid from one or more subterranean formations through a central passageway of the tubing to the well's surface. However, there is a limit to how far downhole tubing can be pushed before friction and buckling becomes excessive. As a consequence, this may limit the length of the well where a down hole tool may be conveyed, limiting the ability to treat or intervene in extended or long reach wells.

Hydraulic fracturing is performed by pumping fluid into a formation at a pressure sufficient to create fractures in the formation. When a fracture is open, a propping agent is added to the fluid. The propping agent, e.g. sand or ceramic beads, chemicals, acids, etc. remains in the fractures to keep the fractures open when the pumping rate and pressure decreases.

In conventional applications, sand and gravel from the formation enters the annulus between an outer diameter of a tool and an inner diameter of the tubing. The propping agent in the annulus prevents the string and injection assembly from moving to the next target zone or to the surface. However, in conventional systems, elements associated with a tool are controlled based on pressure differentials associated with the annulus, which can impact when fracturing is possible Accordingly, needs exist for system and methods for fracturing utilizing the pressure within an inner diameter of a tool to couple the tool with a sliding sleeve, move the sliding sleeve, and set packers.

SUMMARY

Embodiments disclosed herein describe fracturing methods and systems, wherein pressure differentials and fluid flow rates within an inner diameter of a tool may be utilized to stimulate multiple zones, sleeves, or ports with the same tool and different conveying method (i.e.: Coiled Tubing, Stick Pipe).

Embodiments may include a tool, a sliding sleeve, and casing.

The tool may include a check valve, shifting profile, and sealing elements. The tool may be configured to be positioned within the casing, such that an annulus is formed between the tool and casing. Responsive to the tool being pushed and/or pumped to a desired depth, a fluid flow rate or pressure through the inner diameter of the tool may be increased. This may close the check valve to create a closed distal end of the tool. When fluid is pumped in the inner diameter of the tool, the pressure within the inner diameter of the tool may increase. The increase in pressure may cause the shifting profile to be activated to selectively engage the sliding sleeve. Responsive to further increasing the pressure within the inner diameter of the tool, the sealing elements may radially expand between the tool and the sliding sleeve.

The sliding sleeve may be configured to be positioned on an inner diameter of the casing, and slide when the shifting profile is engaged with the sliding sleeve, wherein the sliding sleeve moves based on the pressure within the inner diameter of the tool. Responsive to moving the sliding sleeve, a sleeve port within the sliding sleeve may be aligned with a stimulation port within the casing.

When aligned, fluid flowing within the annulus may be increased, and treatment may be performed over the outer diameter of the tool and out to the geological formation via the stimulation port and the sleeve port.

In embodiments, during treatment of a zone, it may be required to maintain pressure on the inner dimeter of the tool to keep the seal packer activated to maintain the seal for treatment. When treatment of the zone is complete, pressure on the inner diameter of the tool is bleed off, which may allow the tool to reset. The tool may be reset by moving the tool towards a proximal end of the tubing, disengaging the shifting profile from the sliding sleeve. At this time, debris within the tool and well may be cleaned via circulation (i.e.: reverse or direct circulation). Once done, the procedure may repeat, and the next valve may be opened and treated. In embodiments, the shifting profile and the sliding sleeve may limit or restrict the downward movement of the tool.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIGS. 6A, 6B, 6C depict a fracturing system, according to an embodiment.

Figure 1:
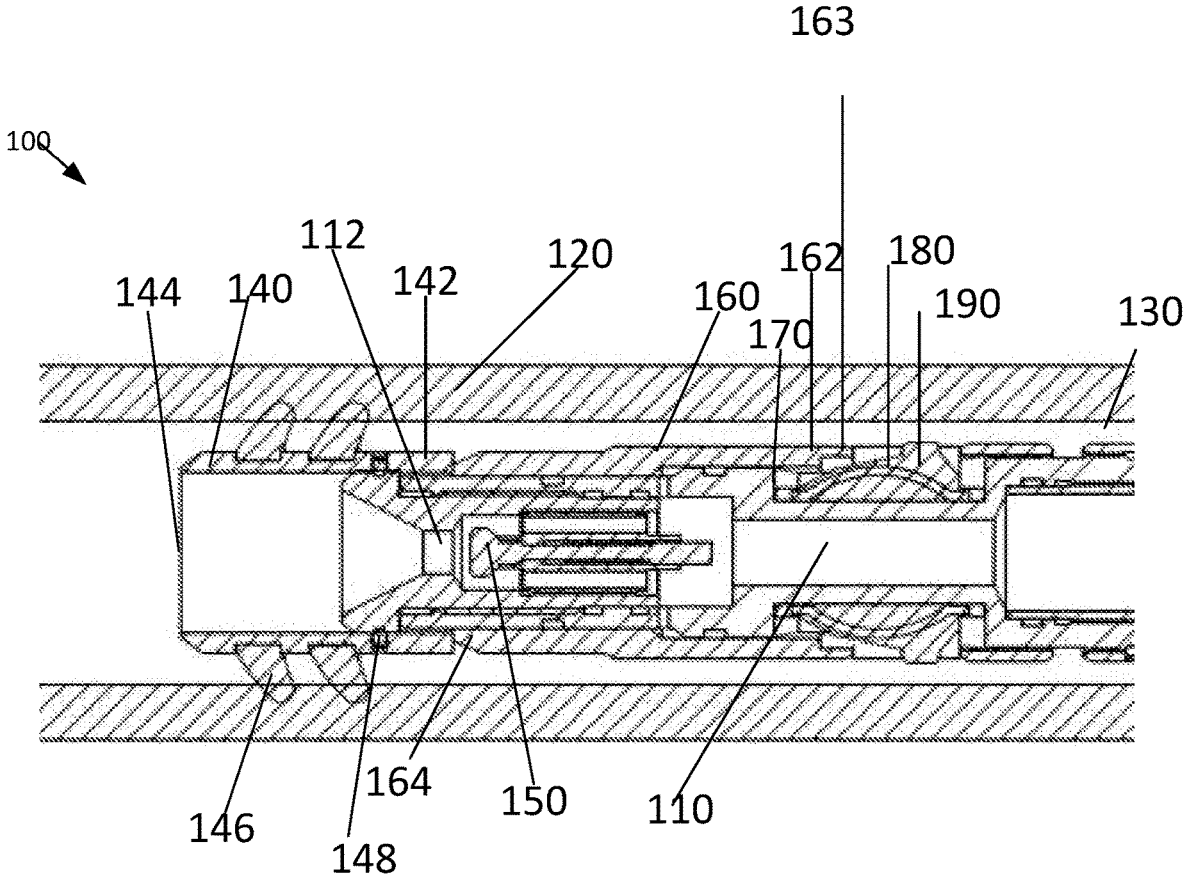
FIG. 1 depicts a fracturing system, according to an embodiment.
Figure 2A:
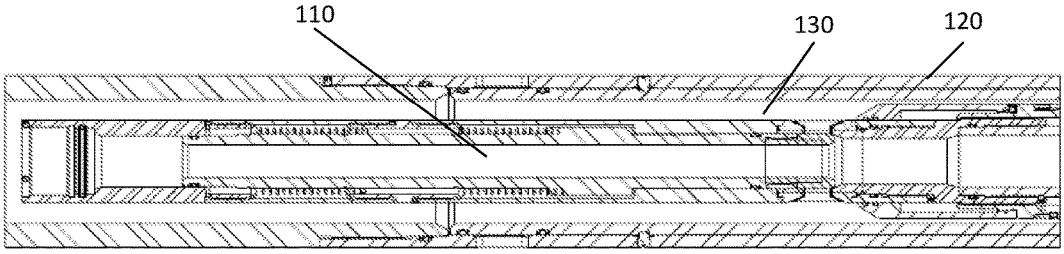
FIGS. 2A, 2B, 2C depict a fracturing system, according to an embodiment.
Figure 2B:
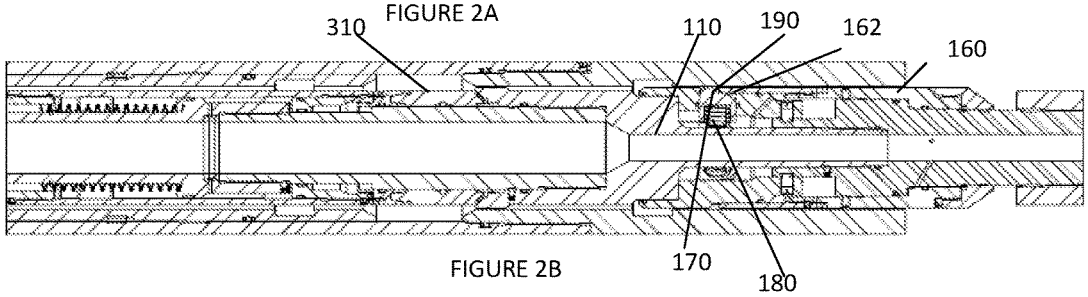
Figure 2C:
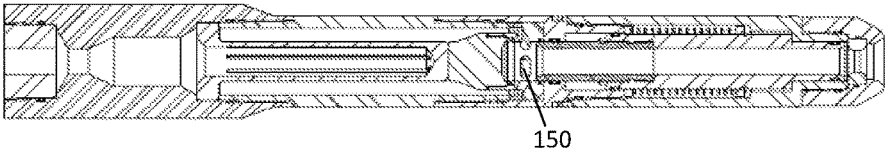
Figure 3:
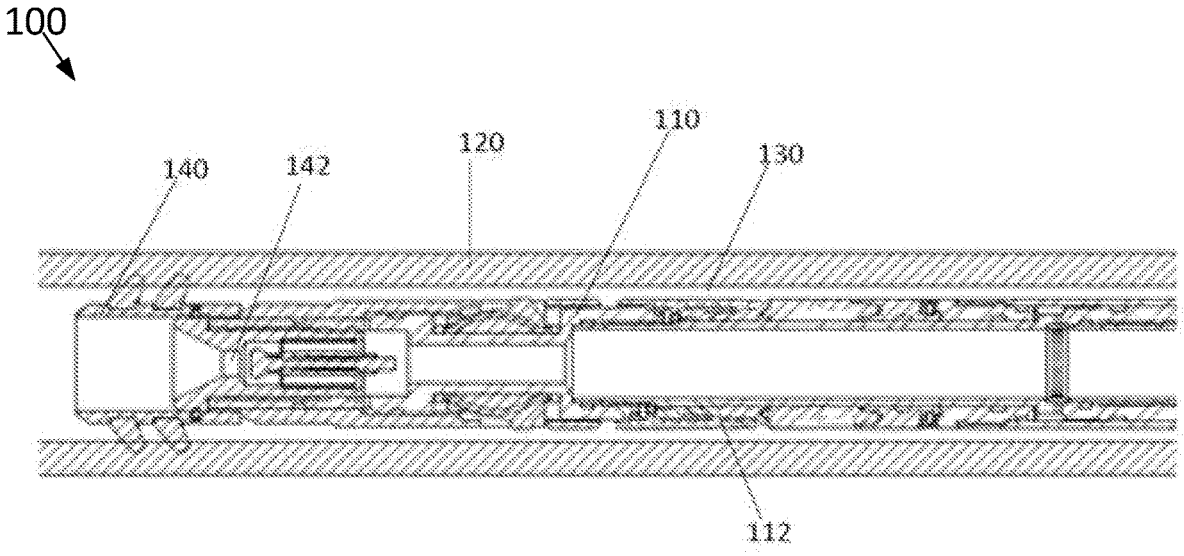
FIG. 3 depicts a fracturing system, according to an embodiment.
Figure 4A:
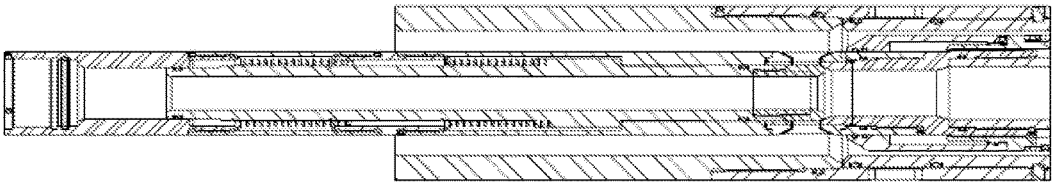
FIGS. 4A, 4B, 4C depict a fracturing system, according to an embodiment.
Figure 4B:
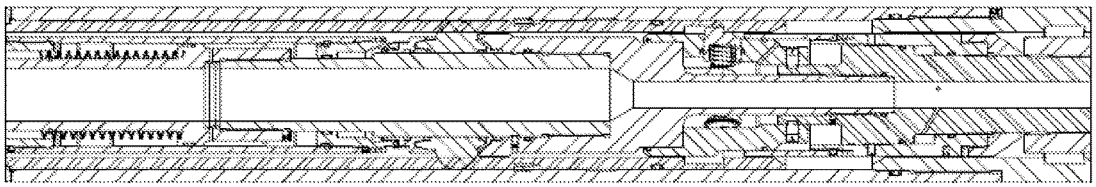
Figure 4C:
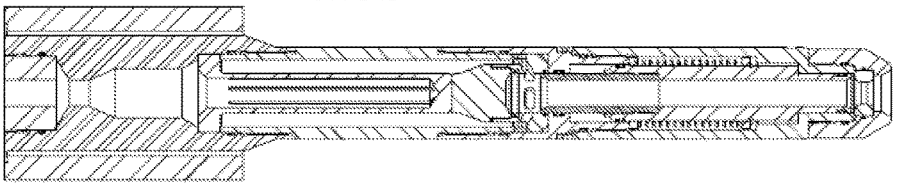
Figure 5:
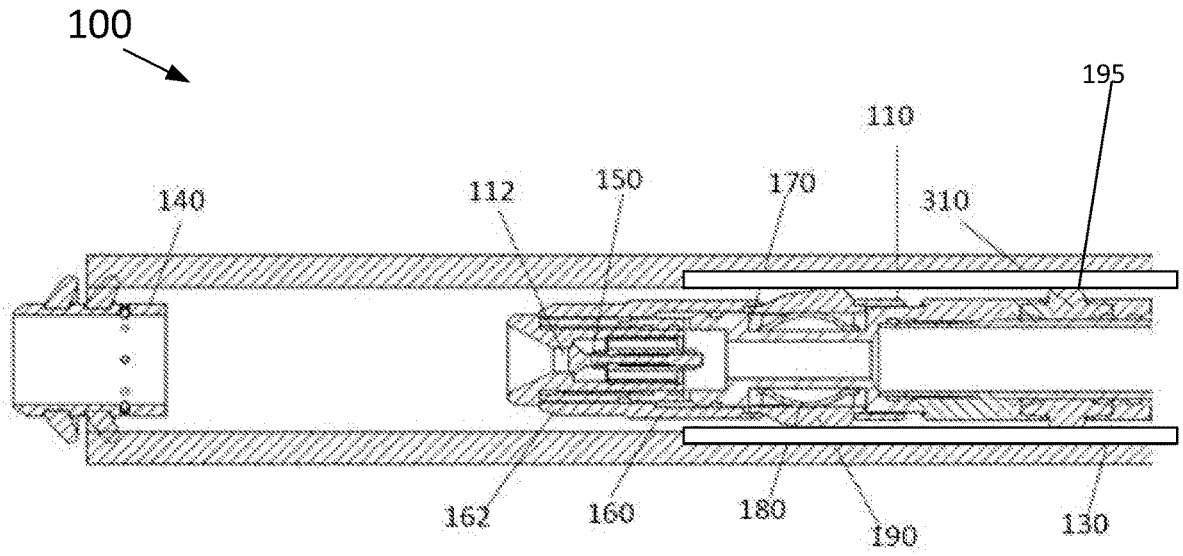
FIG. 5 depicts a fracturing system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIGS. 1, 2A, 2B, and 3C depict a fracturing system 100, according to an embodiment. System 100 may include tool 110 and casing 120, wherein there may be an annulus 130 between an outer diameter of tool 110 and an inner diameter of casing 120.

Tool 110 may include a hollow chamber extending from a proximal end of tool 110 to a distal end of tool 110. The distal end of tool 110 may include port 112. Port 112 may have a smaller diameter than the inner diameter of tool 110 and may be configured to control fluid flowing through the inner diameter of tool 110. Additionally, port 112 may be configured to control pressure levels within the inner diameter of tool 110. Tool 110 may include a dart 140, coupling mechanisms 148, check valve 150, piston sleeve 160, ledge 170, locking mechanism 180, and shifting profile 190.

Dart 140 may be removably coupled to a distal end of tool 110, and be configured to pull and/or push conveying tubing and tool 110 down well. In embodiments, dart 140 may be configured to be coupled with any type of tool, tubing, device, etc. Dart 140 may have a larger diameter than the second end of tool 110, such that an inner circumference of dart 140 is positioned adjacent to an outer circumference of tool 110. Dart 140 may include a first end 142, second end 144, and projections 146, wherein there may be a hollow chamber extending between first end 142 and second end 144.

First end 142 may be configured to be positioned over a distal end of tool 110. Projections 146 may be rubber extensions extending across annulus 130, wherein projections 146 are configured to receive fluid flowing through annulus 130. In embodiments, there may be a limit as to how far down well tubing may be pushed due to buckling. To increase the distance over which tubing 120 may be pulled and/or pushed downward, fluid flowing through annulus 130 may cause dart 140 to pull and/or push tubing further down well. Responsive to the fluid flowing below second end 144 of dart 140, the fluid may enter the hollow chamber within dart 140, and exit dart 140 into tool 110 via port 112. This fluid may then flow out of the proximal end of tool 110. In embodiments, dart 140 may be configured to be sheared away from tool 110 based on pressure increase within the inner diameter of tool 110.

However, in other embodiments, dart 140 may be sheared from tool in different methods. For example, dart 140 may be sheared from tool 110 by increasing the pressure on the outer diameter and restricting the movement of tool 110. This pressure may create an increasing downward force. Responsive to the pressure on the outer diameter of dart 140 increasing past a threshold, dart 140 may be sheared from tool 110. In further embodiments, a restriction, projector, ledge, edge may be installed within the well or casing 120. When dart 140 passes through the restriction, the restriction may release dart 140 from tool 110. Other embodiments may utilize a ball to release dart 140, wherein the ball may be dropped within the well causing a sleeve to shift to release dart 140.

Furthermore, embodiments may include drag blocks or friction devices that are configured allow dart 140 to be removed from a well. The drag blocks or friction devices may be configured to interface with projections 146, wherein projections 146 may be comprised of rubber. Responsive to moving dart 140 towards the proximal end of the well, rubber projection 146 may be sheared from dart 140. One skilled in the art may appreciate the drag blocks or friction devices may be used in combination with J-Slots.

Check valve 150 may be positioned within the inner diameter of tool 110, and be configured to move in a linear axis in parallel to the longitudinal axis of tool 110. Check valve 150 have a smaller diameter than that of tool 110, such that fluid may flow between check valve 150 and the inner diameter of tool 110. Check valve 150 may have a first end having a first diameter and a second end having a second diameter. The first diameter may be smaller than a diameter of port 112, and the second diameter may be larger than the diameter of port 112. In a first orientation, the second end of check valve 150 may be configured to be positioned away from the port 112 to allow fluid to flow across port 112. Alternatively, in a second orientation, a second end of check valve 150 may be configured to be positioned adjacent to port 112 to restrict, limit, inhibit, etc. fluid from flow across port 112 and/or to increase the pressure within tool 110. Accordingly, check valve 150 may be a device allowing fluid to flow through port in both linear directions. By allowing fluid flow in multiple directions, the fluid may flow over tool 110 to clean areas of sand or debris within tool 110, if required. Furthermore, check valve 150 may eliminate the need for a toe sub, as embodiments are able to take return fluid through the inner diameter of tool 110.

In embodiments, responsive to increasing fluid flow through the inner diameter of tool, the second end of check valve 150 may move from the first orientation to the second orientation to close check valve 150. When check valve 150 is closed, pressure within the inner diameter of tool 110 may increase to push piston sleeve 160 to shear dart 140 off tool 110. In embodiments, responsive to decreasing pressure through the inner diameter of tool 110, check valve 150 may move from the second orientation to the first orientation. This may cause the second end of check valve 150 to move away from port 112 to open check valve 150. However, one skilled in the art may appreciate that check valve 150 may be opened or closed in multiple manners, such as dropping a ball to open or close check valve 150.

Piston sleeve 160 may be positioned on an outer diameter of tool 110, and may be positioned between shifting profile 190 and dart 140. Piston sleeve 160 may be configured to move along a linear axis in parallel to the longitudinal axis based on a pressure level within the inner diameter of tool 110. Piston sleeve 160 may include first end 162 with outcrop 163, and second end 164. When check valve 150 is closed, a first end 162 and outcrop 163 of piston sleeve 160 may overhang ledge 170. The first end 162 of piston sleeve 160 may be configured to suppress shifting profile 190 from expanding. When check valve 150 is opened, first end 162 of piston sleeve 160 may slide to not cover ledge 170. This may allow locking mechanism 180 to expand. When check valve 150 is initially opened, second end 164 may be positioned adjacent to port 112. Responsive to closing check valve 150 and moving piston sleeve 160 towards the distal end of tool 110, causing second end 164 to apply force against and shear dart 140 from tool 110.

Ledge 170 may be a sidewall positioned on the outer diameter of tool 110. By positioning outcrop 163 and/or first end 162 of piston sleeve 160 over ledge 170, the outward movement of shifting profile 170 and/or locking mechanism 180 may be suppressed.

Locking mechanism 180 may be a device that is configured to retract, compress, extend, elongate, etc. For example, locking mechanism 180 may be a spring. Locking mechanism 180 is configured to move shifting profile 190 responsive to locking mechanism 180 being extended or compressed. Locking mechanism 180 may be extended or compressed based on the positioning of piston sleeve 160. When piston sleeve 160 is positioned over ledge 170, an inner surface of piston sleeve 160 may restrict the outward movement of locking mechanism 180, such that locking mechanism 180 remains compressed. When first end 162 of piston sleeve 160 does not extend over ledge 170, locking mechanism 180 may be elongated.

Shifting profile 190 may be a device that is configured to allow tool 110 to move along an axis parallel to the longitudinal axis of tool 110 while in a first position, and restrict the movement of tool 110 in a second position.

In the first position, locking mechanism 180 may be compressed and an outer surface of shifting profile 190 may be aligned with an outer diameter of tool 110, such that the outer surface of shifting profile 190 is positioned away from an inner diameter of casing 120. In the second position, locking mechanism 180 may be extended and an outer surface of shifting profile 190 may extend across annulus 130 and be embedded within a female profile on the inner diameter of casing 120. Responsive to interfacing shifting profile 190 with the female profile, tool 110 may be secured in place. However, a sufficient upward force on tool 110 may disengage shifting profile 190 from the female profile Tool 110 may be a pipe, coil, etc. extending from a surface level into a geological formation. Tubing may be configured to be pulled and/or pushed into the desired depth within the well bore via dart 140.

Casing 120 may include a profile that includes a female profile, indention, depression, etc., which may be configured to receive shifting profile 190 to secure tool 110 in place. Casing 120 may be installed in a well before tool 110 is run into the well. Furthermore, casing 120 may include channels, passageways, and conduits extending from a first location on an inner diameter of casing 120 to a second location on the inner diameter of casing 120 to control, maintain, or change the pressure on different sides of a sealing packer element on the tool. Casing 120 may also include channels, passageways, and conduits extending through the casing 120 to perform treatment out of the geological formation.

FIGS. 3, 4A, 4B, and 4C depict system 100, according to an embodiment. Elements depicted in FIGS. 3, 4A, 4B, and 4C may be substantially the same as those described above. For the sake of brevity an additional description of those elements is omitted.

As depicted in FIGS. 3, 4A, 4B, and 4C a hole may be run with tubing. Due to a limit to how far tool 110 may be pushed down due to friction, buckling, etc., to increase the amount of distance tool 110 is displaced into well bore, fluid may be pumped through annulus 130. This fluid may pull/push dart 140 amd tool 110 down the well. Because check valve 150 may be in an open position, when the fluid flows past dart 140, the fluid may flow into the inner diameter of dart 140 and tool 110 via port 142. This fluid may return upward through the well via tool 110 and tubing.

FIGS. 5, and 6A, 6B, and 6C depicts system 100, according to an embodiment. Elements depicted in FIGS. 5, and 6A, 6B, and 6C may be substantially the same as those described above. For the sake of brevity an additional description of those elements is omitted.

In FIGS. 5, and 6A, 6B, and 6C, tool 110 may reach a desired depth that may be aligned with sliding sleeve 195. Sliding sleeve 195 may be a sleeve positioned adjacent to the inner diameter of casing 120. Sliding sleeve 195 may be configured to move in a direction parallel to the longitudinal axis of casing 120. Sliding sleeve 195 may include a sieve port that is configured to align with stimulation port to be in an open position.

When fluid flowing through an inner diameter of tool 110 increases or the pressure within the inner diameter of the tool increases, check valve 150 may move linearly towards the distal end, such that the second end of check valve 150 is positioned adjacent to and covering port 112. By closing check valve 150 and flowing fluid within the inner diameter of tool 110, the pressure within the inner diameter of tool 110 may increase.

The increase in pressure past a first threshold may cause shifting profile 190 to unlock and interface with sliding sleeve 195. Responsive to unlocking shifting profile 190, shifting profile 190 may couple tool 110 and sliding sleeve 195, such that if tool 110 moves downhole due to the pressure within inner diameter of tool 110, then sliding sleeve 195 may correspondingly move.

Furthermore, as the pressure within the inner diameter of tool 110 further increases past a second threshold, sealing elements, such as packers 310 may radially expand across the annulus between the outer diameter of tool 110 and sliding sleeve 195. When packer 310 is activated, portions of packers 310 may extend across annulus 130 and be positioned against the inner diameter of sliding sleeve. This may segregate the annulus to include a lower zone below packers 310 and an upper zone above packers 310.

Figure 7:
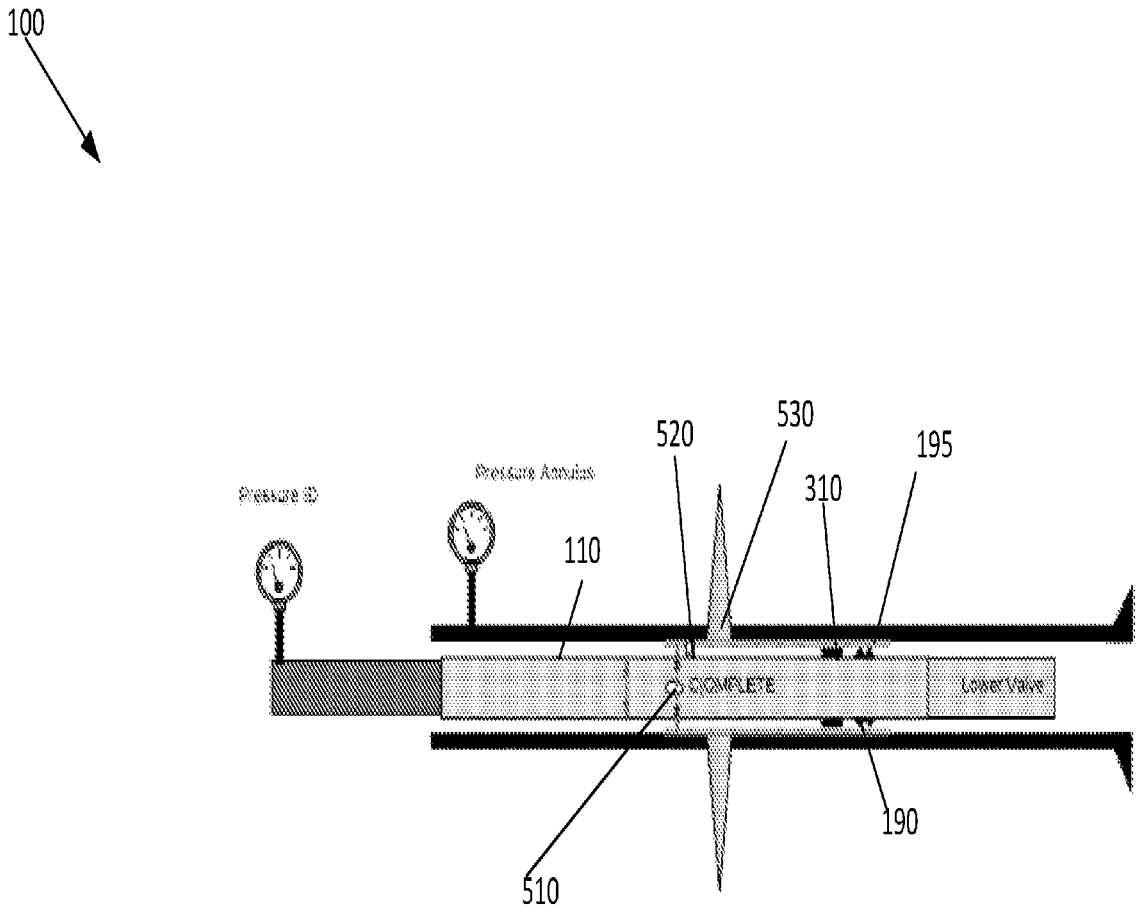
FIG. 7 depicts a fracturing system, according to an embodiment.

FIG. 7 depicts system 100, according to an embodiment. Elements depicted in FIG. 7 may be substantially the same as those described above. For the sake of brevity an additional description of those elements is omitted.

As depicted in FIG. 7, inner tool 110 may be coupled to sliding sleeve 195 via shifting profile 190, and further stabilized together via packers 310. Furthermore, inner tool 110 may include a vent 510. Vent 510 may be an orifice through the sidewalls of tool 110, wherein vent 510 may be configured to equalize a pressure in the upper zone above packers 310 and within tool 110. This equalization may occur responsive to ceasing fluid being pumped through the inner diameter of tool 110.

In embodiments, vent 510 may be a bleed port or nozzle positioned above packers 310 to enable constant flow through the inner diameter of tool 110. Vent 510 may additionally be configured to limit higher pressure within the inner diameter of the tool 110 when check valve 150 is closed. Vent 510 may also be configured to limit packers 310 from being stuck due to debris falling onto the packers 310 be allowing clean fluid to flow through vent 510 into the annulus. Furthermore, if the annulus between the tool 110 and casing 120 is closed on the top of the well, vent 510 may be utilized to increase the pressure in the inner diameter of tool 110 as well as the annulus. This may enable the increased equalized pressure to create more force to move sliding sleeve.

As further depicted in FIG. 7, casing 120 may include a stimulation port 530. Stimulation port 530 may be an orifice extending through casing 120, wherein stimulation port 530 is configured to selectively dispense fluid flowing through the annulus between the outer diameter of tool 110 and sleeve 195 into the geological formation. However, in a closed mode as depicted in FIG. 4, when a sidewall of sliding sleeve 195 covers stimulation port 530, fluids or other materials may not flow through stimulation port 530. However, in an open mode, sleeve port 520 positioned through the sidewalls of sleeve 195 may be configured to be aligned with stimulation port 530. When aligned, fluids and other materials may be configured to flow through the aligned stimulation port and sleeve port 520.

Figure 8:
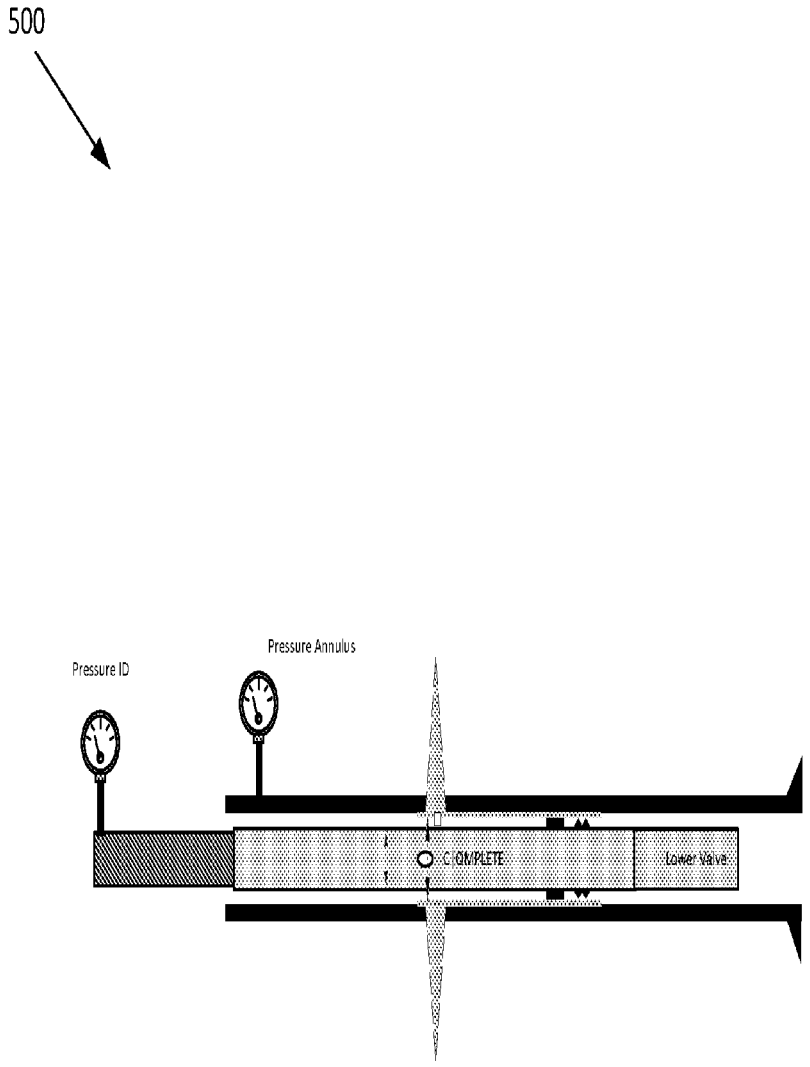
FIG. 8 depicts a fracturing system, according to an embodiment.

FIG. 8 depicts system 100, according to an embodiment. Elements depicted in FIG. 8 may be substantially the same as those described above. For the sake of brevity an additional description of those elements is omitted.

As depicted in FIG. 8, responsive to increasing the pressure within the inner diameter of tool 110, shifting profile 190 may couple sliding sleeve 195 with inner tool 110 when reaching a first pressure threshold within the inner diameter of tool 110, packers 310 may be deployed across the annulus and against sliding sleeve 195 when reaching a second pressure threshold within the inner diameter of tool 110, and tool 110 may move to align stimulation port 530 and sleeve port 520.

Figure 9:
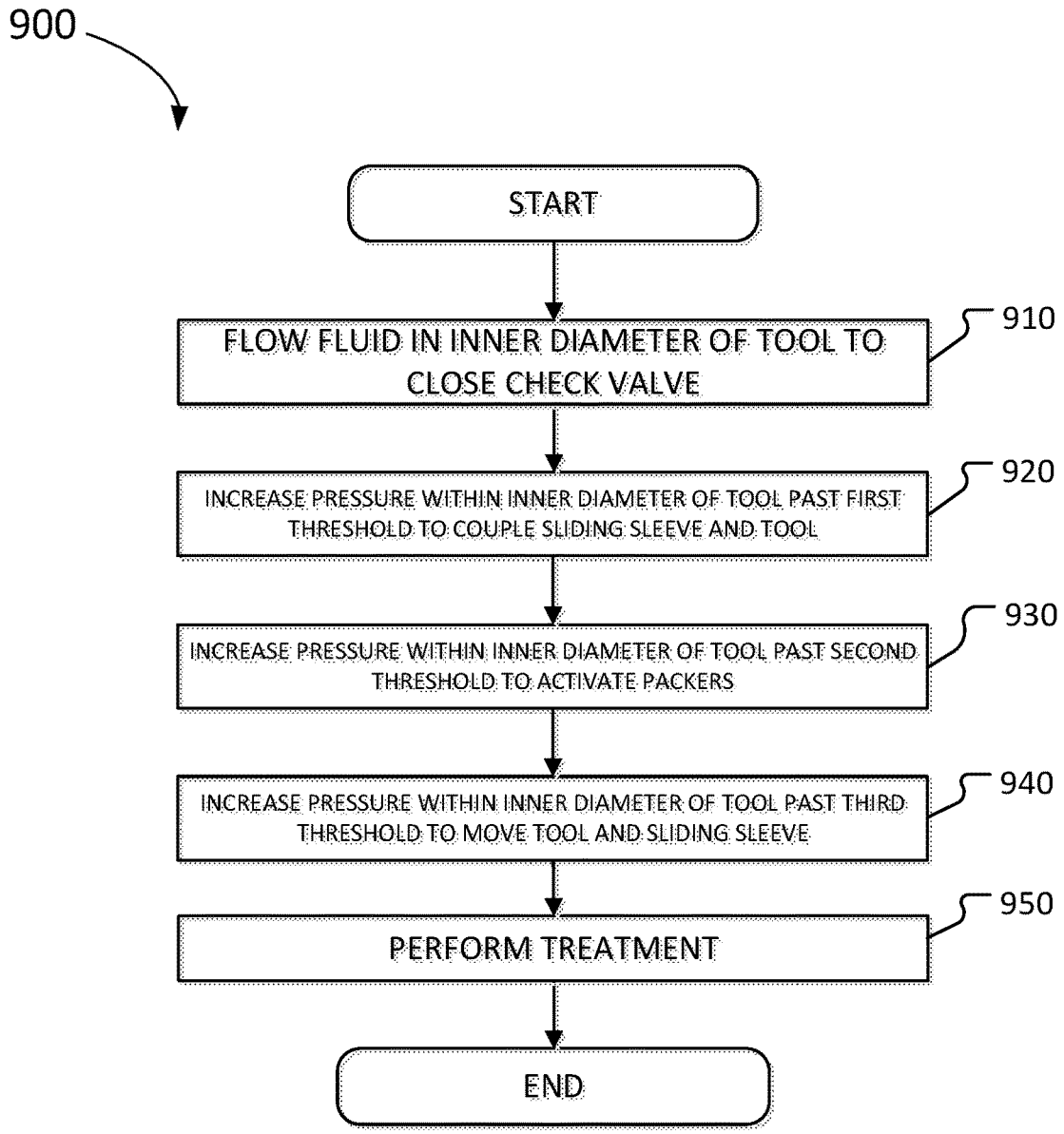
FIG. 9 depicts a method for stimulating a well, according to an embodiment.

Next, fluid may be pumped through the annulus to perform operations associated with the geological formation through stimulation port 520 and sleeve port FIG. 9 depicts a method 900 for stimulating a well. The operations of method 900 presented below are intended to be illustrative. In some embodiments, method 900 may be accomplished with one or more additional operations not described, and/or without one or more of the operations discussed. Additionally, the order in which the operations of method 900 are illustrated in FIG. 9 and described below is not intended to be limiting. Furthermore, the operations of method 900 may be repeated for subsequent valves or zones in a well.

At operation 910, fluid may flow through an inner diameter of tool from a proximal end of the tool towards the distal end of the tool. The fluid flowing through the tool may cause a check valve to close. Responsive to the check valve closing, the pressure within the inner diameter of the tool may increase.

At operation 920, due to the increase in pressure within the inner diameter past a first threshold, a shifting profile may extend across the annulus and be coupled with a sliding sleeve. By coupling the sliding sleeve with the tool via the shifting profile, when the tool moves the sliding sleeve may correspondingly move.

At operation 930, the fluid flow rate through the inner diameter of the tool may increase the pressure within the inner diameter of the tool past a second threshold, wherein the second threshold is greater than the first threshold. This may activate a packer. The activated packer may radially extend across the annulus to form a seal against the sliding sleeve.

At operation 940, the fluid flow rate through the inner diameter of the tool may increase the pressure within the inner diameter of the tool past a third threshold, which is greater than the second threshold. Responsive to increasing the pressure within the inner diameter of the tool, the tool and sliding sleeve may move until a sleeve port extending through the sliding sleeve is aligned with a stimulation port extending through the casing.

At operation 950, a geological formation may be stimulated through the aligned stimulation port and sliding sleeve.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for stimulating a well, the system comprising:

a tool configured to be pumped downhole within a casing in the well;

a sliding sleeve configured to be positioned on an inner diameter of the casing, wherein the casing and the sliding sleeve are positioned downhole before the tool is pumped downhole;

a shifting profile positioned on an outer diameter of the tool that is configured to couple the sliding sleeve and the tool based on a pressure within an inner diameter of the tool after the tool has been pumped downhole to align the shifting profile with the sliding sleeve; and a packer configured to form a seal in an annulus between the tool and the sliding sleeve when the shifting profile and the sliding sleeve are aligned, the packer forming the seal based on the pressure within the inner diameter of the tool, wherein fluid flowing through the inner diameter of the tool creates the pressure within the inner diameter of the tool to set the shifting profile and the packer.

2. The system of claim 1, further comprising:

a check valve configured to cover and uncover a lower port positioned on a first end of the tool, the check valve configured to cover the lower port when the pressure within the inner diameter of the tool exceeds a first pressure threshold.

3. The system of claim 2, wherein the shifting profile is configured to couple the sliding sleeve and the tool responsive to the pressure within the inner diameter of the tool exceeding a second pressure threshold.

4. The system of claim 3, wherein the shifting profile is positioned closer to the first end of the tool than the packer.

5. The system of claim 4, wherein the sliding sleeve and the tool are configured to move from a first position to a second position within the casing responsive to the pressure within the inner diameter of the tool exceeding a fourth pressure threshold.

6. The system of claim 5, wherein the sliding sleeve includes a sleeve port, and the casing includes a stimulation port.

7. The system of claim 6, wherein in the first position the sleeve port and the stimulation port are misaligned, and in the second position the sleeve port and the stimulation port are aligned.

8. The system of claim 1, wherein the tool includes a vent configured to equalize the pressure within the tool and an annulus pressure between the tool and the sliding sleeve.

9. The system of claim 1, wherein a distance across an annulus is greater than the inner diameter of the tool.

10. A method for stimulating a well, the system comprising:

pumping a tool downhole within the casing in the well;

positioning a sliding sleeve on an inner diameter of the casing, wherein the casing and the sliding sleeve are positioned downhole before the tool is pumped downhole;

flowing fluid through the inner diameter of the tool;

coupling the tool and the sliding sleeve via a shifting profile based on a pressure within an inner diameter of the tool after the tool has been pumped downhole and the sliding sleeve is aligned with the shifting profile;

forming a seal, via a packer, in an annulus between the tool and the sliding sleeve when the shifting profile and the sliding sleeve are aligned, the packer forming the seal based on the pressure within the inner diameter of the tool, wherein the fluid flowing through the inner diameter of the tool creates the pressure within the inner diameter of the tool to set the shifting profile and the packer.

11. The method of claim 10, further comprising:

increasing the pressure within the inner diameter of the tool to close a lower port positioned on a first end of the tool via a check valve.

12. The method of claim 11, further comprising:

increasing the pressure within the inner diameter of the tool to be greater than a second pressure threshold;

coupling the sliding sleeve and the tool responsive to the pressure within the inner diameter of the tool exceeding the second pressure threshold.

13. The method of claim 12, wherein the shifting profile is positioned closer to the first end of the tool than the packer.

14. The method of claim 13, further comprising:

increasing the pressure within the inner diameter of the tool to be greater than a fourth pressure threshold;

moving the sliding sleeve and the tool from a first position to a second position within the casing responsive to the pressure within the inner diameter of the tool exceeding the fourth pressure threshold.

15. The method of claim 14, wherein the sliding sleeve includes a sleeve port, and the casing includes a stimulation port.

16. The method of claim 15, wherein in the first position the sleeve port and the stimulation port are misaligned, and in the second position the sleeve port and the stimulation port are aligned.

17. The method of claim 10, further comprising:

equalizing the pressure within the tool and an annulus pressure between the tool and the sliding sleeve via a vent on the tool.

18. The method of claim 10, wherein a distance across the annulus is greater than the inner diameter of the tool.

* * * * *